United States Patent [19]

Burke

[11] 4,422,400

[45] Dec. 27, 1983

[54] MARINE SYSTEM FOR UNLOADING AND LOADING BULK PRODUCT

[75] Inventor: Peter G. Burke, New Orleans, La.

[73] Assignee: Gibeshemael Incorporation, New Orleans, La.

[21] Appl. No.: 271,503

[22] Filed: Jun. 8, 1981

[51] Int. Cl.[3] ..... B63B 25/06

[52] U.S. Cl. ..... 114/73; 414/137; 414/144; 440/34

[58] Field of Search ..... 114/61, 73, 74 R, 72, 114/253, 254; 414/137, 138, 140, 144, 139; 440/33, 34; 141/93; 104/163, 168

[56] References Cited

U.S. PATENT DOCUMENTS

| | | | |
|---|---|---|---|
| 3,307,717 | 3/1967 | Ludwig | 414/139 |
| 3,497,054 | 2/1970 | Van Kleunen | 414/139 |
| 3,554,713 | 1/1971 | Bassett et al. | 114/74 R |
| 3,867,969 | 2/1975 | Garnett | 414/144 |
| 4,003,329 | 1/1977 | Robinson | 414/139 |
| 4,015,731 | 4/1977 | Verschuur | 414/144 |
| 4,106,637 | 8/1978 | Marsden | 414/138 |

*Primary Examiner*—Sherman D. Basinger

[57] ABSTRACT

A marine loading/unloading system for barges, etc. including a floating transfer vessel of catamaran configuration into and through which strings and tiers of barges and large single barges, empty and loaded with liquid or solid bulk product, are moved and positioned for loading and unloading. The barges are moved and controlled externally by means of moorings on endless cables running to anchor barges situated at appropriate locations upstream and downstream of the transfer vessel; and controlled internally by wheel systems positioned on the internal vertical hulls which alternatively (FIGS. 7A vs. 7B) control the movement of the barges during vertical and horizontal, lateral or longitudinal movements. The bulk product, solid or liquid, is loaded and unloaded through hopper and tank systems in the horizontal, upper bridging hull or structure, from and into vessels or ships, and from and into pipelines and other vessels through processing equipment located in the transfer vessel. A lower, below the water-line bridging structure (FIG. 10) can be included for strength and greater buoyancy. For bulk products such as coal, grain, etc. an internal dust or loose particle collection and storage system (FIG. 8) may be used.

19 Claims, 11 Drawing Figures

MARINE SYSTEM FOR UNLOADING AND LOADING BULK PRODUCT

BACKGROUND OF THE INVENTION

1. Field of the Invention

The present invention relates generally to the rapid loading and unloading of a bulk product, solid or liquid, from and into a plurality of barges and single large barges through a floating transfer vessel, with controlled movement of barges into, through, and out of the transfer vessel.

2. Prior Art

In the prior art, floating transfer vessels provided transfer of bulk product by transfer of the product from and into barges moored fore, aft and alongside, from and into vessels moored alongside the transfer vessel; and by the location of a limited number of barges within a dry dock type of hull. The prior art systems generally have not permited the rapid unloading and loading of a large number of barges in an environmentally protected system. Additionally, they do not provide for the complete controlled movement of the barges into and through and out of the transfer vessel. During loading and unloading of the barges, the prior art systems generally have not provide for the temporary storage and processing of the bulk product. They also generally involved complex mechanical and hydraulic system for drydocking the barges and for control of barges during loading and unloading.

Some prior art barge unloading systems disclosed in the patent literature are as follows:

| Patentee(s) | Pat. No. | Issue Date |
|---|---|---|
| Van Kleunen | 3,497,054 | Feb. 24, 1970 |
| Robinson | 4,003,329 | Jan. 18, 1977 |
| Marsden | 4,106,637 | Aug. 15, 1978 |

The Van Kleunen '054 system shows a land-based unloader in which the barge is moved past the unloader by a plurality of barge maneuvering or haul winches.

The Robinson '329 system utilizes a series of longitudinally spaced, opposed, driven wheels which rotate about vertical axes to control and move a barge longitudinally through a loader or unloader.

The Marsden '637 patent discloses a floating vessel into which the barges are located and held in drydock-like fashion during the load transfer process.

SUMMARY DISCUSSION OF THE INVENTION

It is an object of the present invention to provide a marine vessel and system for the rapid loading and unloading of bulk material, liquid and solid, through a floating, self-contained transfer vessel providing temporary storage and equipment for the processing of the bulk material.

Another object of the invention is the controlled movement of a plurality of barges and single large barges into and through and out the transfer vessel, with internal movement and control during loading and unloading of the bulk material.

Other general advantages and objects of the preferred embodiment of the invention are outlined below:

stable base for unloading and loading of product;

integrated operation;

minimal need for shore operations and land facilities;

no capital and energy costs for transport of product over land and then return to water;

no need for extensive levee protection;

ability to relocate temporarily;

ability to locate downriver, shortening vessel movement upriver;

fast vessel loading;

use of combustible particulate matter such as for example coal dust for energy source in non-populated areas;

ability to relocate facility in the event of river movement, or economic or political considerations;

economically efficient;

deck area provides fresh water from rains for use in product transfer and operation of the system;

use of particulate matter or dust for on-board processing;

midsection may be used as a support structure for equipment to shove bulk product in barges to lifts; and storage capacity for fuel and provisions for other vessels, etc.

BRIEF DESCRIPTION OF THE DRAWINGS

For a further understanding of the nature and objects of the present invention, reference should be had to the following detailed description; taken in conjunction with the accompanying drawings, in which like parts are given like reference numerals and wherein.

DETAIL DESCRIPTION OF THE PREFERRED EMBODIMENT

Figure 1:
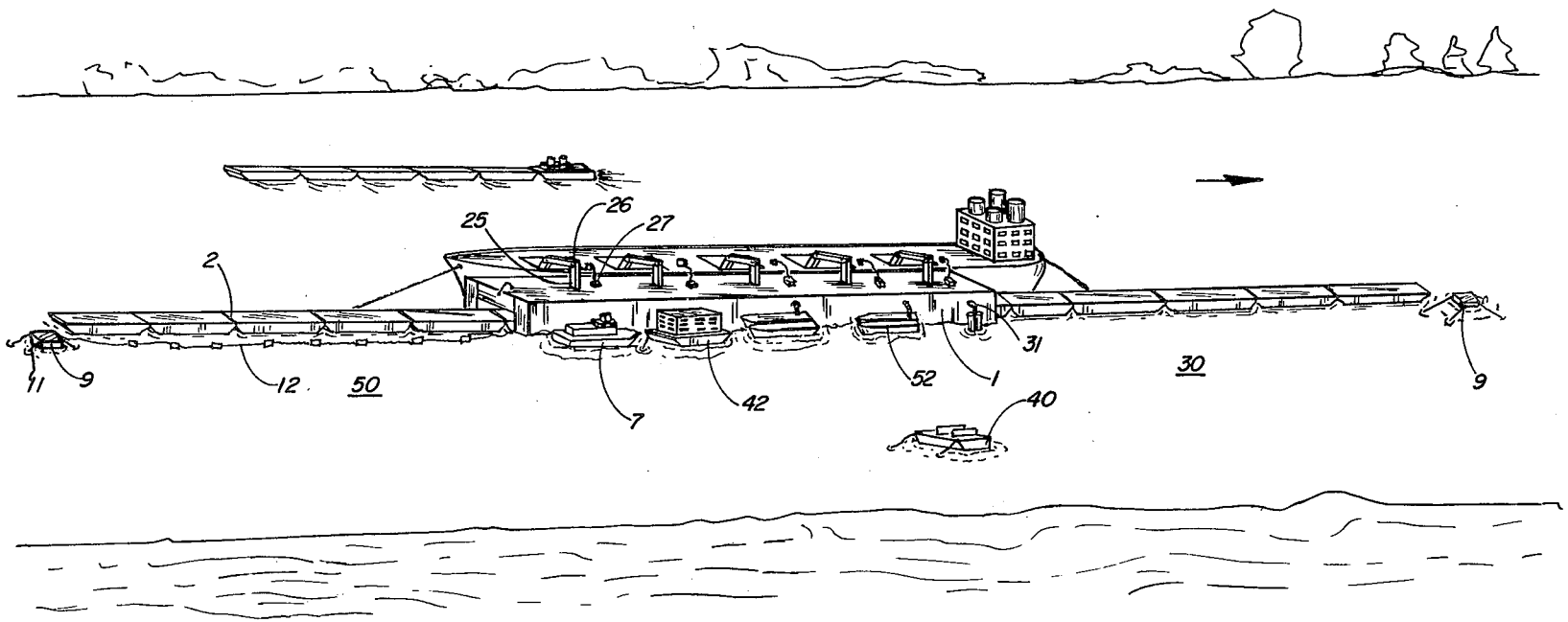
FIG. 1 is a perspective view of the preferred embodiment of the invention in working cooperation with other vessels and ships in a river environment.

Referring to FIG. 1, the preferred exemplary embodiment of the present invention comprises a floating marine vessel and system for the rapid loading and unloading of bulk material, liquid or solid, into and from a plurality of barges and/or large single barges and into and from other vessels, ships and pipelines. The preferred embodiment of the invention comprises a floating transfer vessel 1 which is conveniently anchored to permit access fore and aft and/or both sides, and upper for example (entry) and lower (for example exit) barge handling systems 50, 30, respectively with anchor barges conveniently anchored fore and aft to and removed substantially out away from the transfer vessel 1. Allied equipment such as a river tow boat 7 being refueled and provisioned, quarters boat 42, supply barges 52, anchored navigational barges 40, and product pipeline 31 from or to transfer vessel 1 are shown.

Figure 2:
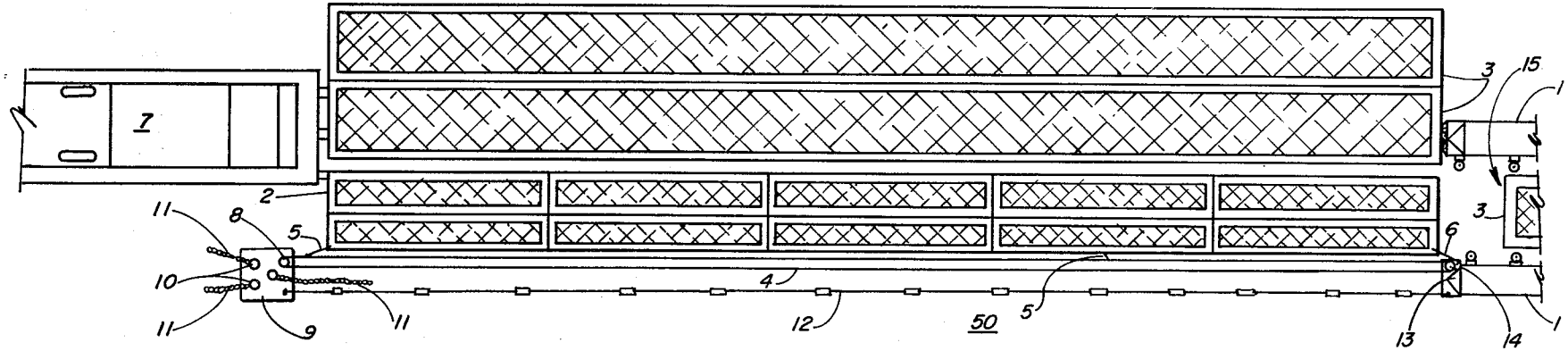
FIG. 2 is an enlarged, topside, partial view of the system of FIG. 1 showing barges moored to the upper, forward, entry barge handling system of the floating vessel of the invention, with a portion of a barge secured internally in the loading/unloading space between the vertical hulls of the transfer vessel (with its upper bridging structure removed to show its interior) of FIG. 1 being illustrated.

Referring to FIG. 2, an exemplary plurality of smaller barges (shown in the figures as an exemplary string or tier 2 of ten barges, five long and two wide) and two specialized barges 3 (for example, barges having outer dimensions of a ten barge string), as convenient in application, is brought to the bow or entry area of the transfer vessel 1 by towboat 7. The barges to be brought into the transfer vessel are moored to a closed or endless, moveable cable 4 by means of fixed mooring cables 5. The barges are also temporarily moored to the forward end of the transfer vessel 1 by means of a fixed mooring cable 6. The string of barges 2 moored to the endless cable 4 is then separated from the other barges 3 which are held against the bow of the transfer vessel 1 by the towboat 7.

The endless cable 4 runs to a sheave or powered capstan 8 situated on an anchor barge 9 anchored at a substantial, sufficient distance from the transfer vessel 1. The anchor barge 9 maintains tension on the endless cable 4 by means of hydraulic or mechanical equipment 10 which takes in and plays out its anchor chains 11. Electrical and/or hydraulic power is supplied to the anchor barge 9 from the transfer vessel 1 through floating, insulated electrical cable and hose 12 and is controlled from the forward barge mover's position 13 by the forward barge mover or by an electronic controller in response to measurements from tension meters on the endless cable 4 and capstan 8.

The endless cable 4 is passed around a drive capstan 14 at the forward end of the transfer vessel 1. The capstan 14 is powered electrically or hydraulically, and is controlled by the forward barge mover 13 or by an electronic controller.

After securing the barges or single barge to the forward end of the transfer vessel 1 by mooring cable 6 and to the endless cable 4 by cables 5 and after the barges are separated from the other barges 3, the mooring 6 to the forward end of the transfer vessel 1 is removed. Drive power is applied to the endless cable 4 pulling the barges with the pulling force being applied to their stern and along their lengths into the open but covered, loading/unloading space (load transfer area) 15 in the transfer vessel 1.

Figure 4:
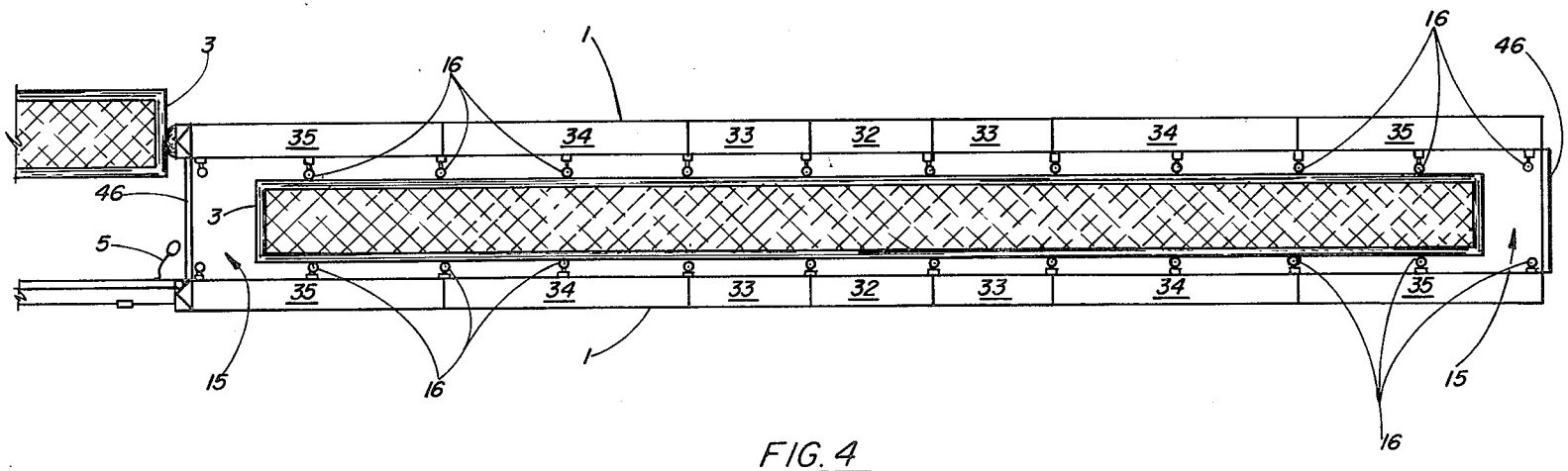
FIG. 4 is an enlarged, topside view of the vertical hulls of the transfer vessel (with its upper bridging structure removed to show its interior) with a barge located within the loading/unloading space of the transfer vessel of the invention.

Referring to FIG. 4, the internal barge control system roller wheels or elements 16 are shown in their longitudinal movement disposition, readily permitting the string of barges or barge (2 or 3) to move through the barge loading/unloading space 15. The barges (2 or 3) are moved into the space until the cable mooring line 5 reaches the forward, entry end of the transfer vessel 1.

Figure 7B:
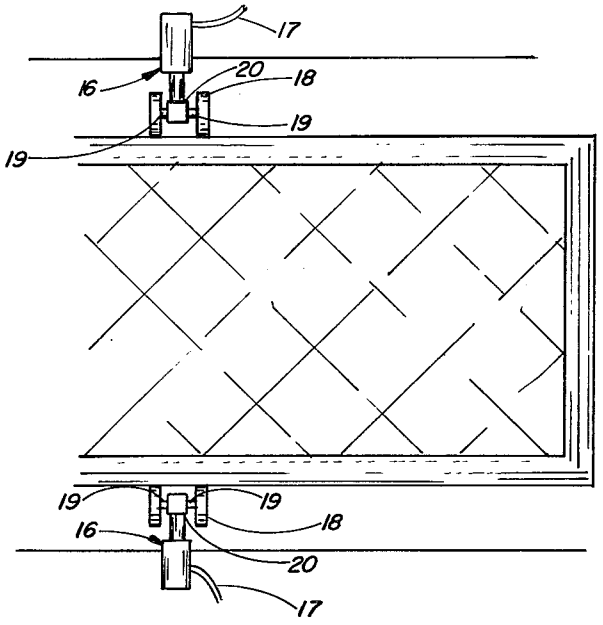
FIG. 7B is an enlarged, partial, plan view showing a portion of a barge and a portion of the internal barge handling system of the floating vessel but in a full vertical movement disposition.
Figure 7A:
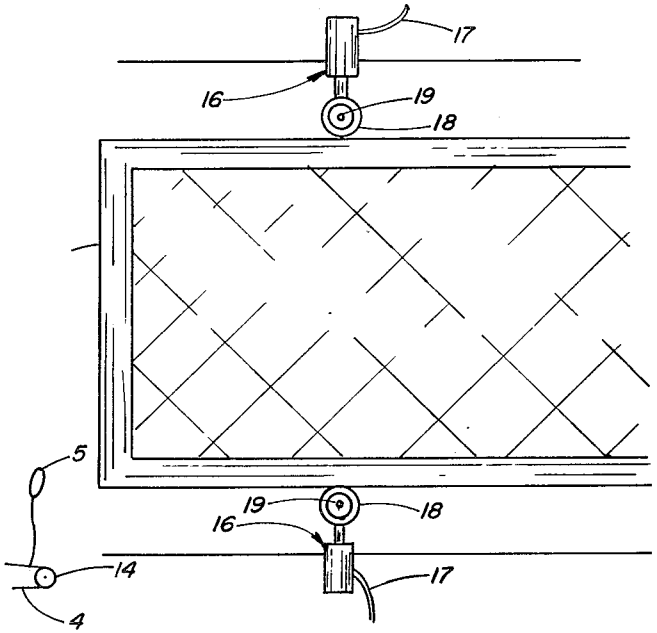
FIG. 7A is an enlarged, partial, plan view showing a portion of a barge and a portion of the internal barge handling system of the floating vessel in its longitudinal movement disposition.

Referring to FIG. 7A, hydraulic ram power through lines 17 is applied to the internal barge movement system elements 16 pressing the wheel systems 18 laterally out against the sides of the barges (2 or 3). The brakes 19 of the internal barge movement system elements 16 are applied, stopping or slowing the barges so that the endless cable mooring line 5 may be removed from the barges. The procedure is repeated at the capstan 14 until the last mooring line 5 on the endless cable 4 reaches the capstan 14 and is removed.

The brakes 19 of the internal barge movement system are released and the barges are allowed to move into the loading/unloading position either by the movement or natural flow of the water (note directional arrow of river flow of FIG. 1) or by electrical or hydraulic power to motors 20 on the shafts on the wheels 18 (note FIG. 7B) of the system. Upon positioning of the barges for loading/unloading, the barges are stopped by the brakes 19 of the internal barge movement and control system.

Referring back to FIG. 4, after positioning the barges in the loading/unloading space 15, the end doors 46 of the transfer vessel 1 are lowered to close off the ends of the loading/unloading space. The end doors 46 are raised or lowered by a windlass system 47 (note FIG. 6) and are lowered to a position to permit a sufficient quantity of air to enter the loading/unloading space but to at least substantially close off the entry and exit ends of the vessel 1.

Referring to FIG. 7B, the brakes 19 of the internal barge control and movement system are eased and the wheel systems 16 are rotated ninety degrees, hydraulically, electrically or mechanically, to a vertical movement disposition. Such position permits convenient vertical movement of the barge during loading and unloading as its load varies. In their second, vertical movement disposition, the wheel systems 16 can be used to resist longitudinal movements; alternatively, clutches can be included, if desired, to permit the wheel systems 16 to rotate under pressure to allow the wheel systems 16 to align with other movements of the barges between the two ninety degree dispositions.

Figure 6:
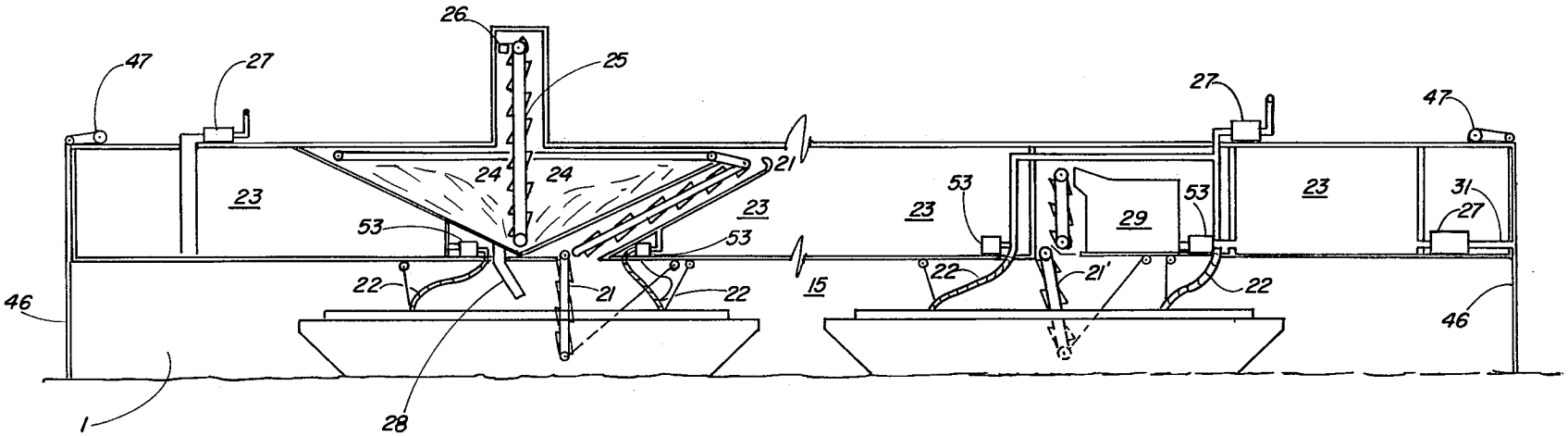
FIG. 6 is an enlarged, longitudinally sectioned, partial, view showing the transfer vessel in a configuration to load and unload bulk material through the upper storage hoppers and tanks (left side portion of figure), or through upper processing equipment and tanks, pumping and pipe systems (right side portion of figure).

Referring to FIG. 6 (left side), conveyor (21), hose (22) and pumping (53) systems are then activated to load and unload the barges from or into the upper tanks 23 and the hopper systems 24.

During loading or unloading, minimum braking may be applied to the internal barge control system elements 16 to dampen any surge of the barges. During loading and unloading, the hydraulic rams may be used to move the barges laterally to facilitate loading and unloading, particularly when such lateral ram power systems are included in both banks of control elements 16, or one bank or side is resiliently mounted.

During loading and unloading of the barges, solid material can be received from or discharged into alongside-vessels through the upper conveyor system 25 (note FIG. 6) and the horizontal movement conveyor systems 26 (note FIG. 1) or liquid material can be received from or discharged into the alongside-vessels and pipelines (not illustrated) through a pumping system 27 (note FIGS. 1 & 6). Barges may be loaded through the tank systems 23 and pipe and pumping systems 22 and through the hopper systems 24 and loading shutes 28.

Referring to the right side of FIG. 6, liquid material may be loaded and unloaded through the tank systems 23 and pipe systems 22, and solid material may be loaded and unloaded through a processing system 29. Other operations in this configuration are similar to the left side of FIG. 6. The processing equipment 29 permits the receipt and delivery of bulk material, liquid and solid, from and into alongside vessels, and from and into pipelines, and from and into barges moored within the load transfer area 15 of the transfer vessel 1. For example, without limitation, bulk material such as coal may be moved from barges by conveyor 21 to the upper horizontal hull for weighing, sampling, crushing, and mixing with a fluid such as water, alcohol, petroleum and other liquid products, and pumped through pumps 27 out of the transfer vessel to alongside vessels and through pipelines 31 to a vessel or other means of transportation and use situated at a distance.

Upon completion of loading or unloading of the barges, the end doors 46 are opened, the brakes of the internal barge control system elements 16 are released, and the roller wheels 18 are rotated back to the degree needed or desired about their lateral, horizontal axes (FIG. 7B to 7A) up to their horizontal or longitudinal movement disposition.

Figure 3:
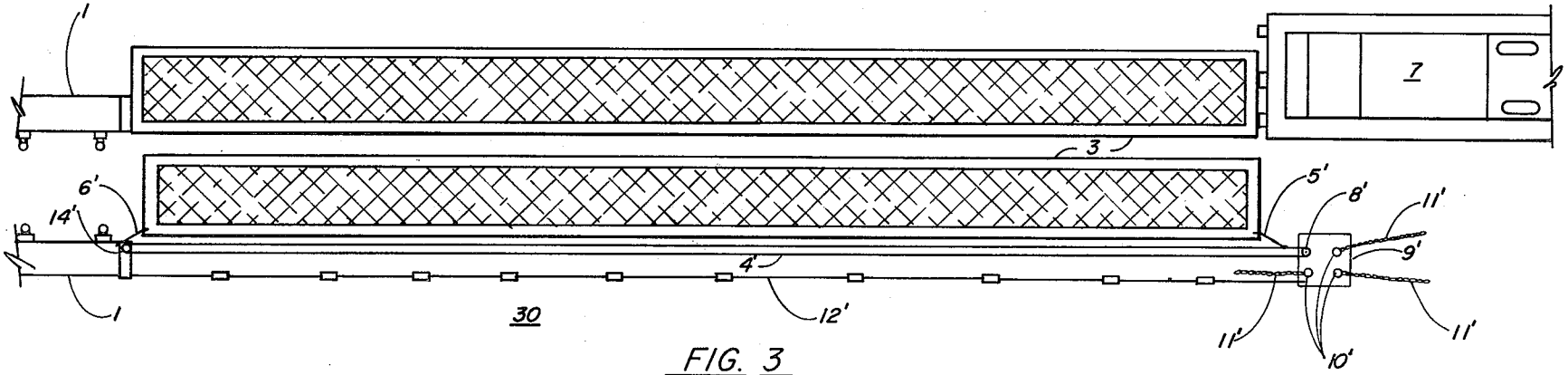
FIG. 3 is an enlarged, topside view of the lower, aft or exit barge handling system of the floating vessel of the invention, with the aft portion of the loading/unloading space between the vertical hulls of the transfer vessel (with its upper bridging structure removed to show its interior) of FIG. 2 being illustrated.

Referring to FIG. 3, the wheel system elements 16 rotate and permit the barges to move to the aft or exit end of the transfer vessel 1 where they are secured to the mooring of the aft external barge control system 30 in similar fashion to that which took place in association with the forward entry, external barge control system 20. Because of the similarity of operations of the forward and the aft external control systems 20, 30, the details of the operation will not be repeated for brevity purposes, and the analogous elements of each are similarly numbered with the latter (aft system 30) using primed numbers. The aft barge mover releases the brakes 19 of the internal barge control system and activates the aft external barge control system 30, pulling the barges out of the transfer vessel. The forward end of the barges are secured to a mooring abaft the aft end of the transfer vessel 1. The barges are ultimately removed by towboat 7 or other means of navigation.

Referring back to FIGS. 2, 3, and 4, the description of the operations above may be reversed, with movement of barges from the downstream, aft mooring system into the loading/unloading space 15 of the floating transfer vessel 1 for load transfer, and the loaded (unloaded) barges are then moved out of the loading/unloading space by means of the internal barge movement system (16) and the upper, forward external barge handling system 30. If convenient for operations, barges entering the system from upstream and downstream may be removed through the same end after loading and unloading.

Referring to FIG. 4, the vertical hulls of the transfer vessel 1 are divided into lower compartments such as those for engines 32, liquid fuel 33, ballast with pumps and piping for filling and pumping out the ballast compartments 34, and dust collectors 35. Upper compartments of the vertical hulls and the upper, horizontal bridging hull may be used for storage of supplies, spares, lubricants, refrigeration spaces, dry goods and other products to replenish the fuel, lubricants, food stores and other necessities for operation of the vessel 1 and other vessels and towboats alongside.

Figure 8:
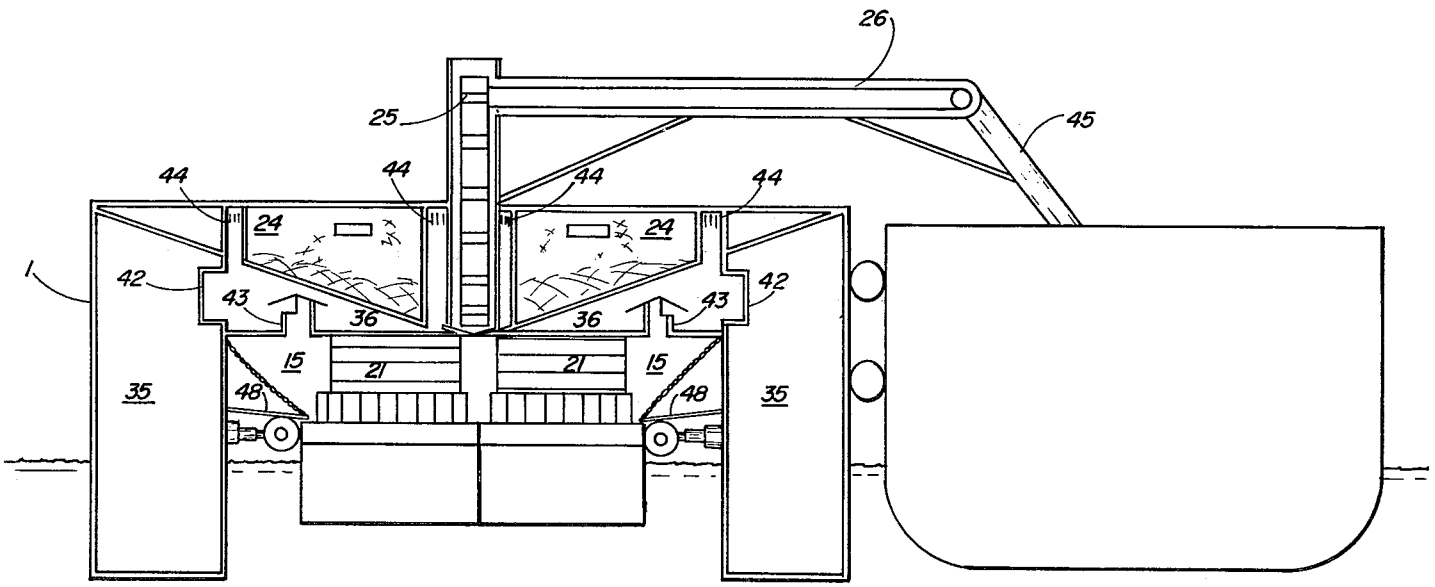
FIG. 8 is an end cross-sectional view of the transfer vessel showing the transfer vessel in a configuration to load and unload solid bulk product into and from a barge through the upper hopper system, and also showing the vertical hulls and horizontal hull, and spaces below the hopper system for evacuation of air and dust from the conveyor systems, and an alongside transportation vessel.

Referring to FIG. 8, when the transfer vessel 1 is used to transfer solid bulk cargo such as for example coal, phosphorus, grain or the like, particulate matter in the form of dust is generated around the load transfer area 15 and air is drawn from the exterior under the end doors 46 (note FIG. 6) and other exterior vents in the transfer vessel 1, through the loading/unloading space 15 and lower conveyor system 21, upper hopper 24 and conveyor systems 25, 26 and discharge pipes 45, and evacuated by fans 42 and by the engines, drawing air and dust through a duct system of stacks 43 and vents 44 from those areas. The air and dust from the bulk material is evacuated through the duct space 36 formed by the hopper system 24 and discharged into the dust collecting compartments 35. The dust may be processed and removed from the compartments 35 or, if combustible, mixed with engine fuel with associated mixing means to assist in fueling the engines of the transfer vessel 1 or otherwise used as an energy fuel source for power generation. Hinged frames 48 with canvas or other convenient material may be lowered from the sides of the vertical hulls to rest on the decks of the barge or barges, to reduce the area of the loading/unloading space to be air evacuated, and to catch any dust not directly removed by the system. Such dust may be conveniently removed from the covered frames 48 by air movement or other vacuum systems.

Figure 9:
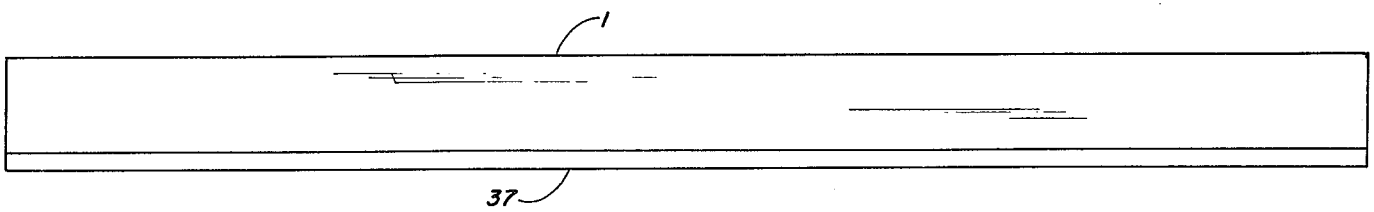
FIG. 9 is a longitudinal view of the the transfer vessel of the invention with a lower horizontal buoyancy hull affixed.
Figure 10:
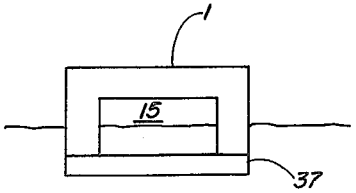
FIG. 10 is a stern view of the transfer vessel of FIG. 9 with its lower horizontal buoyance hull affixed.

Referring to FIGS. 9 and 10, the buoyancy and strength of the transfer vessel 1 may be increased by the addition of a lower, horizontal bridging hull 37 located substantially below the water line. The lower hull 37 may be divided into compartments and filled with or evacuated of water by pumps located on the transfer vessel 1. As can best be seen in FIG. 10, the spaced, parallel, vertical hulls and the upper and lower bridging structure form a box-like configuration in lateral cross-section.

Figure 5:
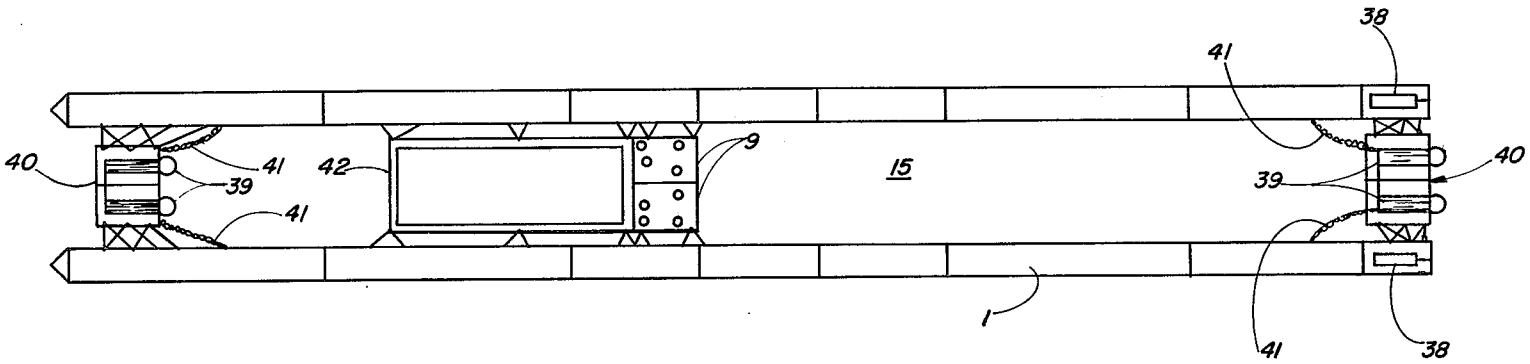
FIG. 5 is a topside view of the vertical hulls and loading/unloading space of the transfer vessel (with its upper bridging structure removed to show its interior) similar to FIG. 4 but showing the location of navigational barges for movement of the transfer vessel and its allied equipment in the interior space of the transfer vessel.

Referring to FIG. 5, the transfer vessel 1, with allied equipment and vessels (such as quarters barge 42 and anchor barges 9), may be controlled and moved to different locations by means of built-in self-propulsion equipment 38. The transfer vessel 1 may also be moved by propulsion equipment 39 on barges 40 moored internally in the loading/unloading space 15 of the transfer vessel 1 and powered by electricity from the transfer vessel 1 through electrical cables 41 or powered by other fuel sources.

The foregoing described embodiment represents only one version of the present invention, and many, substantial changes in structure, arrangements, operations and approach can be made in it.

Because many varying and different embodiments may be made within the scope of the inventive concept herein taught, and because many modifications may be made in the embodiment herein detailed in accordance with the descriptive requirements of the law, it is to be understood that the details herein are to be interpreted as illustrative and not in a limiting sense.

What is claimed is:

1. A marine system for transferring bulk product loads from and/or into barges and the like, comprising in combination:

(a) a floating transfer vessel having load transfer means for transfering a load between said transfer vessel and at least one barge and having an entry end and an exit end and the load transfer area there between;

(b) entry barge handling means for moving barges to said transfer vessel, including a separate, entry, anchored floating structure substantially removed out away from said transfer vessel;

an extended, moveable, closed, endless, entry line extending from the entry end of said transfer vessel to a spaced entry point on said separate, entry floating structure;

temporary barge connection means carried by said entry line for temporarily connecting said entry line to a barge; and entry drive means associated with said entry line for causing said entry line and its barge connection means to move from said spaced entry point inwardly toward said entry end of said transfer vessel moving the barge to said transfer vessel; and (c) exit barge handling means located at the opposite end of said transfer vessel from said entry means for moving barges away from said transfer vessel, including a separate, exit, anchored floating structure substantially removed out away from said transfer vessel;

an extended, moveable, closed, endless, exit line extending from the exit end of said transfer vessel to a spaced exit point on said separate, exit flowing structure;

temporary barge connection means carried by said exit line for temporarily connecting said exit line to a barge; and exit drive means associated with said exit line for causing said exit line and its barge connection means to move toward said spaced exit point outwardly away from said exit end of said transfer vessel moving the barge out away from said transfer vessel.

2. The marine system of claim 1, wherein said transfer vessel has laterally spaced, parallel hulls forming at their bow between them said entry end and at their stern said exit end, and wherein said vessel has an upper, bridging structure extending between said hulls substantially above the water line, said load transfer means being located at least in part on said upper bridging structure, said hulls and said upper bridging structure forming between them an open but bridged load transfer area for the barge(s).

3. The marine system of claim 2, wherein said transfer vessel further includes a lower, bridging structure extending between said hulls substantially below the water line, forming with said hulls and said upper bridging structure a box-like configuration in lateral cross-section.

4. The marine system of claim 2, wherein said hulls include within them compartment means for engines, fuel, ballast, particulate matter collection, refrigeration, lubricants, stores and other necessities for the operation of said vessel; and said upper bridging structure contains compartment means for tanks, hoppers, pumps, air and particulate matter evacuation systems, vertical and horizontal load conveying systems, and load processing equipment.

5. The marine system of claim 2, wherein said bridging structure covers said transfer area and wherein end closures are included at the entry and exit ends formed by said hulls to at least substantially close-off the ends of said load transfer area.

6. The marine system of the claim 2, wherein there is further included within said load transfer area an internal barge movement control system laterally extending out from the interior sides of said hulls comprising a series of longitudinally spaced, opposed roller wheel means including rotatable, cylindrically configured roller wheels for engaging the sides of the barges in said load transfer area, each of which wheel means is rotatable of at least the order of ninety degrees about horizontal, laterally extending axes to and from a first disposition in which the axes of rotation of said roller wheels are at least generally vertically disposed which permits longitudinal movements of barges through said load transfer area and to and from a second disposition in which the axes of rotation of said roller wheels are at least generally horizontally disposed which permits vertical movements of barges but can resist longitudinal movements.

7. The marine system of claim 6, wherein at least some of said roller wheels are power driven to positively drive the barge(s) longitudinally through said load transfer area.

8. The marine system of claim 6, wherein there is further included braking means associated with said roller wheels for varying the resistance of said roller wheel to turn.

9. The marine system of claim 6, wherein at least the roller wheels on one said hulls are moveable under power in a lateral direction and the opposing means are also laterally moveable, the powered set of roller wheels being usable to position the barge(s) laterally in the load transfer area.

10. The marine system of claim 2, wherein the load involved is a bulk, non-liquid cargo in which particulate matter is produced in the air during load transfer, and wherein there is further included on said transfer vessel a particulate matter collection system, comprising:

storage compartment means in at least one of said hulls for storing the collected particulate matter;

powered fan means associated with said load transfer area for sucking up from the air surrounding said load transfer area particulate matter in the air; and duct means extending between said fan means and said storage compartment means for conducting the collected particulate matter from said fan means to said storage compartment means.

11. The marine system of claim 10, wherein there is further included extended surface means moveably attached to said transfer vessel for closing off the side areas surrounding said load transfer area to restrict the amount of particulate matter that might otherwise fall into the water.

12. The marine system of claim 11, wherein said extended surface means comprises covered frames pivotably mounted on the interior sides of said hulls, said covered frames extending laterally out away from said hulls towards and to the barge(s) in said load transfer area when in their lowered, operative dispositions.

13. A marine transfer vessel for transferring bulk product loads from and/or into barges and the like, comprising:

at least two laterally spaced, parallel, floating hulls, said hulls at one end forming a barge entry end and adjacent thereto a load transfer area;

an upper bridging structure extending between said hulls substantially above the water line over said load transfer area;

load transfer means located in part on said upper bridging structure for transferring a load between the transfer vessel and at least one floating barge in said load transfer area, said hulls and said upper, bridging structure forming between them said load transfer area with open ends but bridged over from above by said bridging structure and covered on the sides by said hulls, said load transfer area in use always having water in it to a sufficient depth to float the barges; said load transfer area further including an internal barge movement control system laterally extending out from the interior sides of said hulls comprising a series of longitudinally spaced, opposed roller wheel means, including rotatable, cylindrically configured roller wheels, for engaging the sides of the barges in said load transfer area, each of which wheel means is rotatable of at least the order of ninety degrees about horizontal, laterally extending axes to and from a first disposition in which the axes of rotation of said roller wheels are at least generally vertically disposed which permits longitudinal movements of barges through said load transfer area and to and from a second disposition in which the axes or rotation of said roller wheels are at least generally horizontally disposed which permits vertical movements of barge but which can resist longitudinal movements.

14. The marine transfer vessel of claim 13, wherein at least some of said roller wheels are power driven to positively drive the barge(s) longitudinally through said load transfer area.

15. The marine transfer vessel of claim 13, wherein at least the roller wheels on one of said hulls are moveable under direct power in a lateral direction toward the other hull and the opposing means are also laterally moveable, the powered set(s) of roller wheels being usable to position the barge(s) laterally in the load transfer area.

16. The marine transfer vessel of claim 13, wherein the load involved is a bulk, non-liquid cargo, such as for example coal, phosphorus, grain or the like, in which particulate matter is produced in the air during load transfer, and wherein there is further included on said transfer vessel a particulate matter collection system, comprising:

storage compartment means in at least one of said hulls for storing the collected particulate matter;

powered for means associated with said load transfer area for sucking up from the air surrounding said load transfer area particulate matter in the air; and duct means extending between said fan means and said storage compartment means for conducting the collected particulate matter from said fan means to said storage compartment means.

17. A marine transfer vessel for transferring bulk product loads from and/or into barges and the like, the load involved being a bulk, non-liquid cargo, such as for example coal, phosphorus, grain or the like, in which particulate matter is produced in the air during load transfer, comprising;

at least two laterally spaced, parallel, floating hulls, said hulls at one end forming a barge entry end and adjacent thereto a load transfer area;

an upper bridging structure extending between said hulls substantially above the water line over said load transfer area;

load transfer means included on the vessel for transferring a load between the vessel and the load transfer area; said hulls and said upper, bridging structure forming between them said load transfer area with at least one generally open end but covered over from above by said bridging structure and on the sides by said hulls, said load transfer area in use always having water in it to a sufficient depth to float the barges;

a particulate matter collection system included on the vessel, comprising:

storage compartment means in at least one of said hulls for storing the collected particulate matter, powered fan means associated with said load transfer area for sucking up from the air surrounding said load transfer area particulate matter in the air, and duct means extending between said fan means and said storage compartment means for conducting the collected particulate matter from said fan means to said storage compartment means; and extended surface means moveably attached to the transfer vessel for closing off the side areas surrounding said load transfer area to restrict the amount of particulate matter that might otherwise fall into the water.

18. The marine transfer vessel of claim 17, wherein said extended surface means comprises covered frames pivotably mounted on the interior sides of said hulls, said covered frames extending laterally out away from said hulls towards and to the barge(s) in said load transfer area when in their lowered, operative dispositions.

19. The marine transfer vessel of claim 17, wherein end closures are included at the entry and exit ends formed by said hulls to at least substantially close-off the ends of said load transfer area.

* * * * *